US009387535B2

(12) United States Patent
Darling et al.

(10) Patent No.: US 9,387,535 B2
(45) Date of Patent: Jul. 12, 2016

(54) APPARATUS AND METHOD FOR SAFELY DEPRESSURIZING MILLING VIALS

(71) Applicant: U.S. Army Research Laboratory ATTN: RDRL-LOC-I, Adelphi, MD (US)

(72) Inventors: Kristopher A. Darling, Havre de Grace, MD (US); Micah J. Gallagher, Conestoga, PA (US); Anthony J. Roberts, Chesapeake City, MD (US); Laszlo J. Kecskes, Havre De Grace, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 578 days.

(21) Appl. No.: 13/742,380

(22) Filed: Jan. 16, 2013

(65) Prior Publication Data

US 2014/0196813 A1 Jul. 17, 2014

(51) Int. Cl.

| | |
|---|---|
| ***B02C 17/18*** | (2006.01) |
| ***B22F 9/04*** | (2006.01) |
| *C22C 1/10* | (2006.01) |

(52) U.S. Cl.

CPC . *B22F 9/04* (2013.01); *B02C 17/18* (2013.01); *B22F 2009/041* (2013.01); *C22C 1/1084* (2013.01)

(58) Field of Classification Search

CPC ... B22F 9/04; B22F 2009/041; C22C 1/1084; B02C 23/04; B02C 23/24; B02C 13/31; B02C 18/0084; B02C 23/18; B02C 25/00; B02C 18/0007; B02C 2018/168; B02C 17/1805; B02C 18/16; B02C 17/18

USPC ..... 241/14, 18, 30, 31, 37.5

See application file for complete search history.

(56) References Cited

PUBLICATIONS

Stic Plus Included as "Stick_Plus_13742380_List.pdf".*
Stic Patent Search Included as "13742380-480350-Proquestpatents.pdf".*
Stic NPL Search Included as "13742380-480350-Proquestnpl.pdf".*

* cited by examiner

*Primary Examiner* — Mark Rosenbaum
(74) *Attorney, Agent, or Firm* — Alan I. Kalb

(57) ABSTRACT

The invention is an apparatus and method for safely depressurizing milling vials. The invention utilizes a machinist vise in communication with a pneumatic air cylinder mounted in a jig inside glove box enclosure. The invention utilizes a method for safely depressurizing milling vials. The milling vials are placed into the machinist vise inside the enclosure. The ram of the pneumatic air cylinder is placed on top of the milling vial and the pneumatic air cylinder is pressed firmly against the cap of the milling vial. Next, the air inside the enclosure is evacuated of atmosphere after which the pressure is slowly released from the pneumatic air cylinder. During this stage of the method the operator is a safe distance from the enclosure. As pressure is removed from the pneumatic air cylinder the ram is retracted and the cap of milling vial is removed.

17 Claims, 3 Drawing Sheets

200

APPARATUS AND METHOD FOR SAFELY DEPRESSURIZING MILLING VIALS

GOVERNMENT INTEREST

Government Interest—The invention described herein may be manufactured, used, and licensed by or for the U.S. Government without the payment of royalties thereon.

FIELD OF INVENTION

This invention relates to an apparatus and method for safely depressurizing milling vials. More specifically, for safely depressurizing high energy mechanical alloying milling vials.

BACKGROUND OF THE INVENTION

Powder metallurgy represents an important branch of materials processing technologies. Typically, such operations entail the generation of new phases or structures from a blend of powdered precursors, which consist of pure elements or chemical compounds. The constituents may be in any of the three states of matter, solid, liquid, or gas. The blending method, its complexity, and extent may vary from a simple, quick shaking operation to long periods of careful and precise atomic level mixing of the constituent. Powder metallurgy also encompasses monolithic powder processing, such as that occurring during high-energy milling, wherein the objective is not the creation of a new phase, but the reduction of the initial particulates into fine or ultrafine (i.e., milli-, micro-, or nanoscale precursors and the concomitant modification of their internal structure.

It is important to realize that while powder metallurgy is usually associated with metals-based research, the handling and processing of powders are commonplace in many industries. Multiple examples can be found in the food processing, agricultural, and pharmaceutical industries, not only at the laboratory scale, but also on larger scales. Various names exist for identifying such operations. These include terminology such as blending, mixing, milling, grinding, alloying, or mechanical alloying, etc.

During all of these processes, energy is imparted to the powdered material. Depending on the desired level of mixing, the amount of energy deposited into the mixture varies by orders of magnitude. That is, the resultant blend has a significant, and usually undetermined, amount of stored potential energy. The intention of this processing methodology is the improved physico-chemical and mechanical properties of the powdered materials. The improvements in physical and chemical properties may translate into greater mechanical strength, ductility, or chemical reactivity.

Parasitic heating is an unintended side effect of this processing. Imparted energy may be dissipated in the heating of the powdered material as well as the surrounding medium. That is, there will be an increase in the temperature of the milled powder as well as a corresponding increase in the temperature of the surrounding media.

Temperature can easily be controlled but heat from a chemical reaction cannot. The primary source of the increase in reactivity, or the ability to quickly release stored potential energy (sometimes explosively), is associated with the greatly reduced particle size (which translates into a large surface area). Thus, the finer the resultant powdered material, the greater its reactivity. The greater reactivity may be harnessed with the intended exposure of the powdered materials to other chemical substances. However, the unintentional, uncontrolled, or untimely exposure to other substances needs to be avoided. In some situations, when the other substance is simply the ambient atmosphere, catastrophic outcomes could result, if extreme vigilance was not practiced.

The handling of the powders during processing, storage, loading, unloading, and post-processing is known to those skilled in the art. For example, processing of the powdered material is carried out in hermetically sealed vessels or containers, loaded and unloaded in a protective environment, and stored in a device such as an inert-gas glove box apparatus. Glove boxes are designed to store powdered or reactive materials in a low oxygen and low later content environment. Typically, the ambient atmosphere is evacuated and replaced by an inert atmosphere; after which, the levels of reactive gases are carefully monitored.

Such an apparatus not only offers access to the controlled inert environment, but also offers a stand-off distance and containment for protecting the operator, if something unexpected were to happen. While a glove-box apparatus eliminates most of the concerns associated with storage, it does not address how the operator is to unload the contents of the milling container or vessel. Thus, there is a need for a device that allows for the safe opening and sealing of such containers and vessels.

In the past, there have been documented instances where the opening of such vessels after processing the material unknowingly resulted in a forceful, extremely rapid, explosive release of the contents severely injuring the operator. The explosive forces were directly attributed to a single or multiple chemical reaction(s) between the contents of the vessel and the ambient atmosphere. The freshly exposed, nascent powdered material surfaces are highly susceptible and will readily react with the components of air (oxygen or nitrogen).

The contents of the vessels may consist of the powdered material that is being processed, the milling media, and processing agents. The milling media, generally consisting of high-strength, high-hardness steel or ceramic spheres (e.g., ball bearings), which are designed to facilitate the breakdown and reduction of the particulates; they usually remain inert and do not contribute to enhancing the properties of the product material. In contrast, the processing agents are designed to enhance or retard the milling process, or potentially alter the reaction products. As such, these may be liquids, solids, or gases.

Thus, there is a need for a device that allows for the safe depressurization of such containers and vessels. Therefore, the increased risks to the operator come from the combination of these several factors: dramatically increased particulate surface area which lowers the auto-ignition threshold or barrier, leading to much more rapid reaction kinetics; presence of process agents which may have decomposed; and gaseous byproducts under pressure.

All of these factors can readily contribute to the instantaneous decompression and simultaneous ignition of fuel contained in the vessel. As few as one to as many as one hundred ball bearings can be used in conjunction with milling; and, the size of the bearings may range in size from 1/16 to 1 inch in diameter. During an explosive decompression, the ball bearings become projectiles or shrapnel, with a potential to kill or maim the operator. Given the intrinsic nature of the powdered material or materials being milled, and the type of processing control agent, it is difficult to anticipate all possible reactions. Thus, there is a need for a simple, reliable, safe, and routinely useable method and device to vent, decompress, and open milling vessels in a safe controlled manner without risk or harm to the operator.

BRIEF SUMMARY OF THE INVENTION

The invention described herein is a device, referred to as the "vial guard," heretofore. It is constructed to and has been used to safely open commercially available steel milling vessels designed to be used in high energy mechanical grinding, alloy, and mixing operations. It is important to realize that the concepts and procedures described in this invention are applicable to all types of milling vessels that contain a combination of fuel, oxidizers, and milling media at a higher than ambient temperature and under pressure.

However, the actual device described in this invention was specifically designed to work with milling vessels, or milling vials which fit into a single- or dual-vial mill, manufactured and distributed by SPEX-Certiprep Corporation. Vials such as this are common and heavily used in industrial, government, and university laboratories. These vials contain the powdered materials to be milled, the processing agent, and the milling media (i.e., ball bearings). The vials described here come in two forms: those made from hardened tools steel and those from stainless steel.

Usually, the cylindrical vials have a uniform wall thickness of about ⅛-inch and either have a flat or hemispherical bottom. They are capped off with a flat plate, fitted with a recessed O-ring seal. The upper lip of the vial is threaded and a hermetic seal is made by tightly screwing a retaining cap made from aluminum onto the threads. The retaining cap is actually a ring with its center missing. It is this one-inch diameter hole that forms the basis of the present invention.

During milling operation, arising from internal heating, pressure continues to build up. Under these conditions, an explosion could potentially occur if the vial heats up too much, causing the steel to weaken and lose its strength. However, a far more likely explosive decompression scenario may occur if the seal between the vial and the flat plate is imperfect, as it may lead to leakage of the contents onto the threads of the aluminum retaining cap or the exterior threads of the vial. The source of the explosion is usually traced back to the rapid release of the contents (solid fine particulates, liquids, and or gases), in conjunction with the formation of a hot spot or spark, initiated from frictional heating of the particulates leaked onto and trapped in the threads. Prior to the realization that a vial guard device was needed, a careful search was performed of what commercial products may have been available. No such similar apparatus or device was found.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
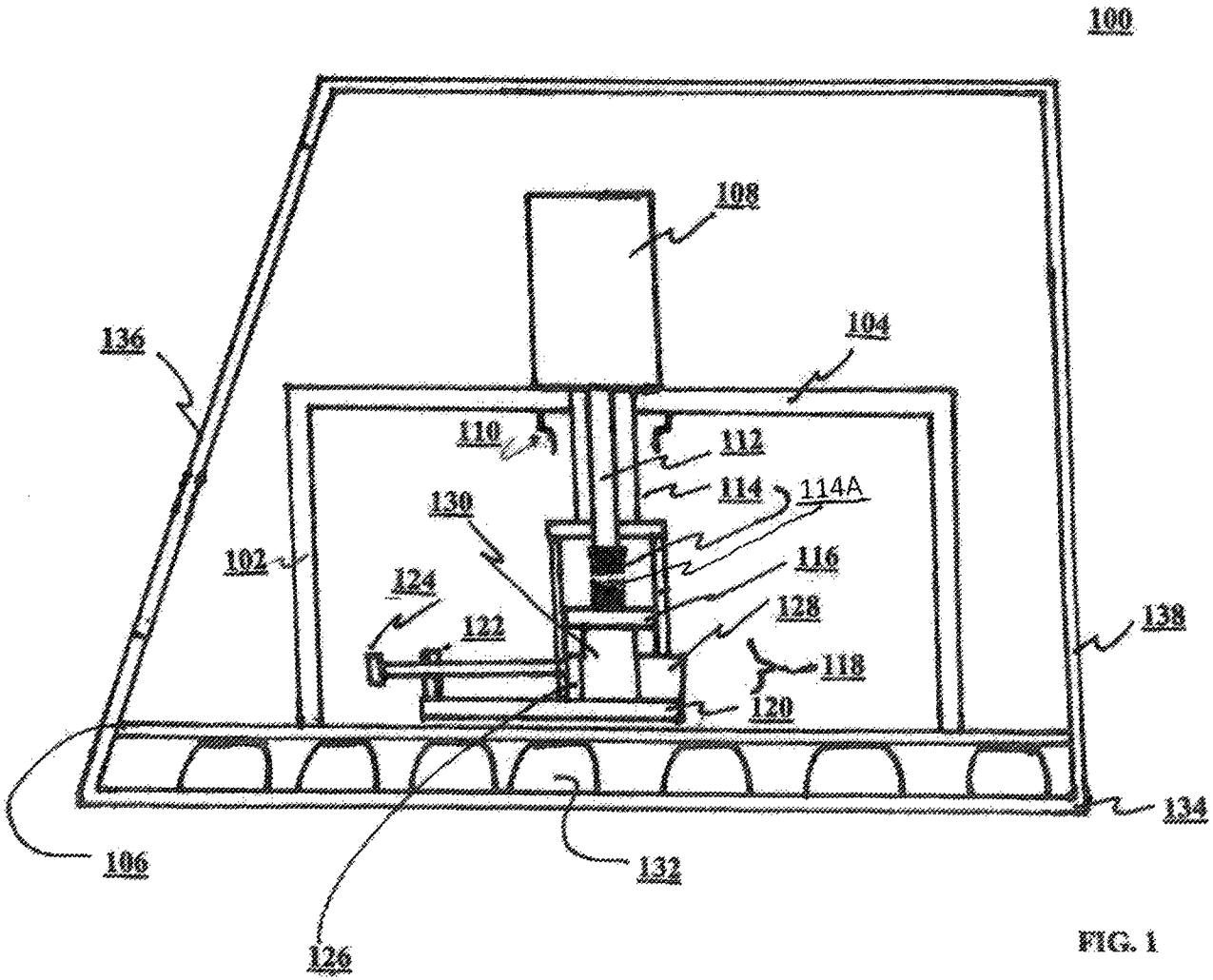
FIG. 1 depicts a side sectional view of the apparatus according to at least one embodiment of the present invention.

FIG. 1 depicts a side sectional view of the apparatus (100) in accordance with at least one embodiment of the present invention. Not shown are the atmospheric control systems that are used to evacuate the enclosure (134). An apparatus is placed inside a high purity enclosure (134), for the embodiment described herein a "glove box" (134) has been utilized, the inventors have contemplated all high purity enclosures for the invention in which a controlled atmosphere can created and maintained. Specifically, controlling oxygen and $H_2O$ levels are of critical importance. The side view of the invention (100) has been depicted to show the internal components of the invention. The apparatus inside the enclosure (134) includes but is not limited to the following: a support plate (102), top plate (104), bottom plate (106), a pneumatic air cylinder (108), spring retention clasps (110), locking pin (112), push rod (114), end piece (114A), and blast prevention cap (116), mated to a suitably sized drill-press vise (118) and its subcomponents, namely the base of the vise (120), threaded screw plate (122), a screw-in locking bolt (124), moving vise grip (126), stationary vise grip (128); and, the SPEX milling vial (130), with its lid (better depicted in FIG. 2 as 206). The jaws of the vise are formed to match the curvature of the vial (130). The vise is attached to the framework by the use of bolts (not shown) such that it remains fixed with respect to the pneumatic push rod assembly.

Additionally, the entire apparatus is placed on ten, 3.25-inch diameter industrial grade, rubber cups (132), designed for vibration or shock absorption. The bottom plate (106) is attached to the glove box (134) housing and is abutted against the front (136) and backside (138) housing panels of the glove box; note, the front of the glove box consists of a transparent panel (not shown), which may be a polycarbonate, acrylic or any of the following including but not limited to the materials bearing the trade names of Lexan, Lucite, Plexiglas, Persex, etc., which facilities viewing the interior contents. For simplicity, the access holes for the operator's hands to the glovebox have been omitted from this drawing.

Figure 2:
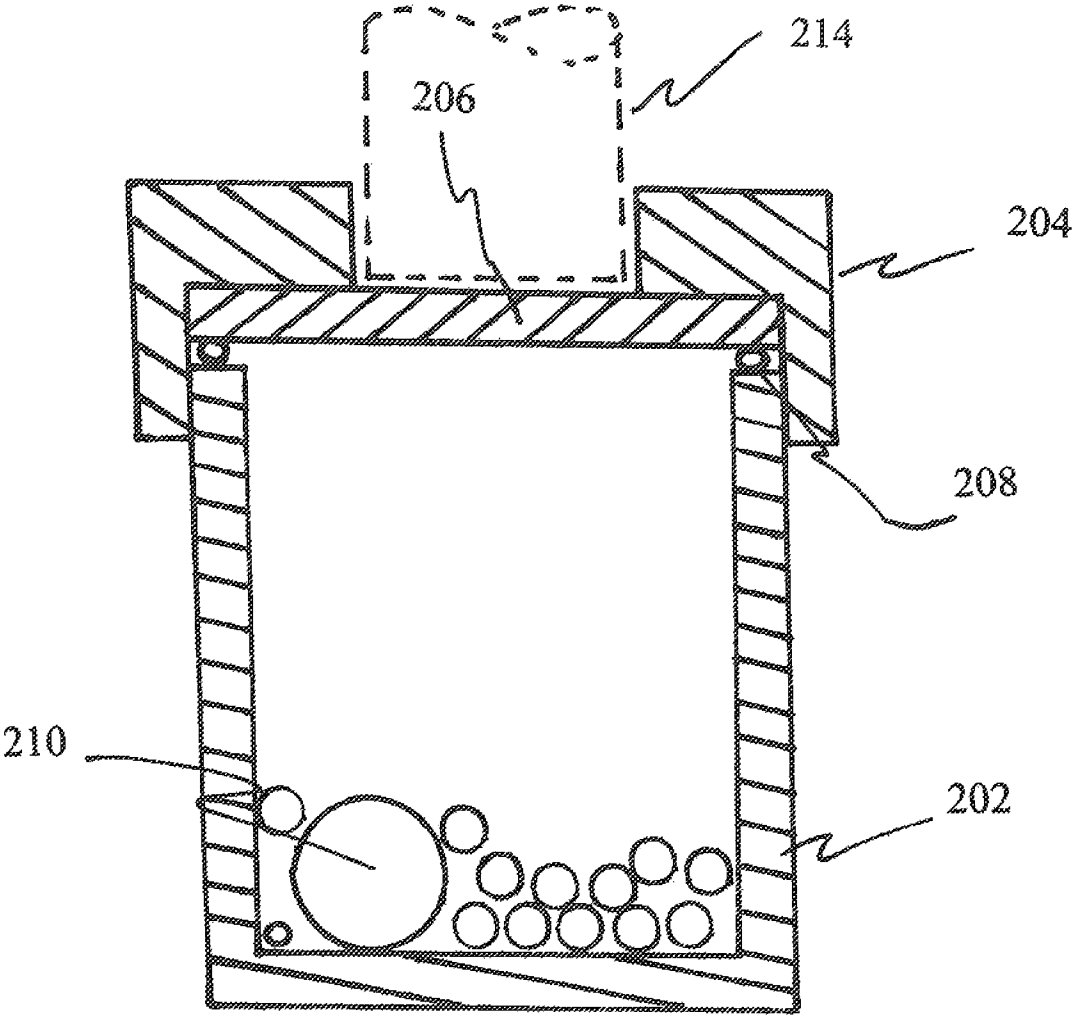
FIG. 2 depicts a sectional view of a milling vial as the type used in the present invention.

FIG. 2 depicts a sectional view of the milling vial (200) and its parts including the aluminum retaining ring according to at least one embodiment of the present invention. The main body (202) of the vial (200) is made from either stainless or hardened steel. The lid (206) is fitted with a recessed O-ring (208) sealing the vial (200). The schematic also shows the aluminum retaining cap (204) and the milling media (210), depicted here as milling balls (210). The central aperture (214) in the aluminum retaining cap (204) allows the push rod (shown in dashed lines) with its end to directly place pressure on the flat surface of the vial's lid (206). The central aperture (214) allows the removal of the aluminum retaining cap (204) without disturbing the disposition of the vial's lid (206).

The inventors have contemplated the use of different size machining vises (not shown) for use with different size milling vials. While any off-the-shelf generic drill-press vise could be utilized for the purpose of the present invention, the described embodiment entails the use of a small-scale vise for use with the standard vials used in any of the SPEX SamplePrep 8000M or 80000 Mixer Mill (single [−M] or dual [−D] mill). For larger vials, a correspondingly larger vise may be used. As such, the vise in the current embodiment has a 3.5-inch jaw opening, 1.5 inch jaw depth, and 3 inch jaw width. The vise is also equipped with two bolt-flanged mounts for fastening to the bottom plate. The stock jaw pads were removed and replaced with nominally 6000 series aluminum alloy jaws which were affixed to the vise. The modified jaws are milled to match the radius of the milling vial's curvature.

While the milling operations may take place either outside or inside the protective environment offered by the confinement of a glove box. Depressurization and opening of the milling vessel should always be done under the protective shielding and oxidant poor environment of the glove box.

It is expected that the vial guard would be located inside a high purity argon glove box with nominal oxygen and H2O levels usually less than 10 ppm. Argon is an inert, non-reactive gas. This environment essentially eliminates or dramatically reduces the possibility of a finely divided powder, flammable gases/liquids and combinations thereof, produced during high energy milling, grinding, or alloying to react with an oxygen or reactive gas atmosphere. In other words, the explosive reaction or spark may still occur; however, its impact is greatly reduced, if not entirely eliminated. Furthermore, there is now a stand-off distance between the operator and the vessel, reducing the scale of the injury.

Figure 3:
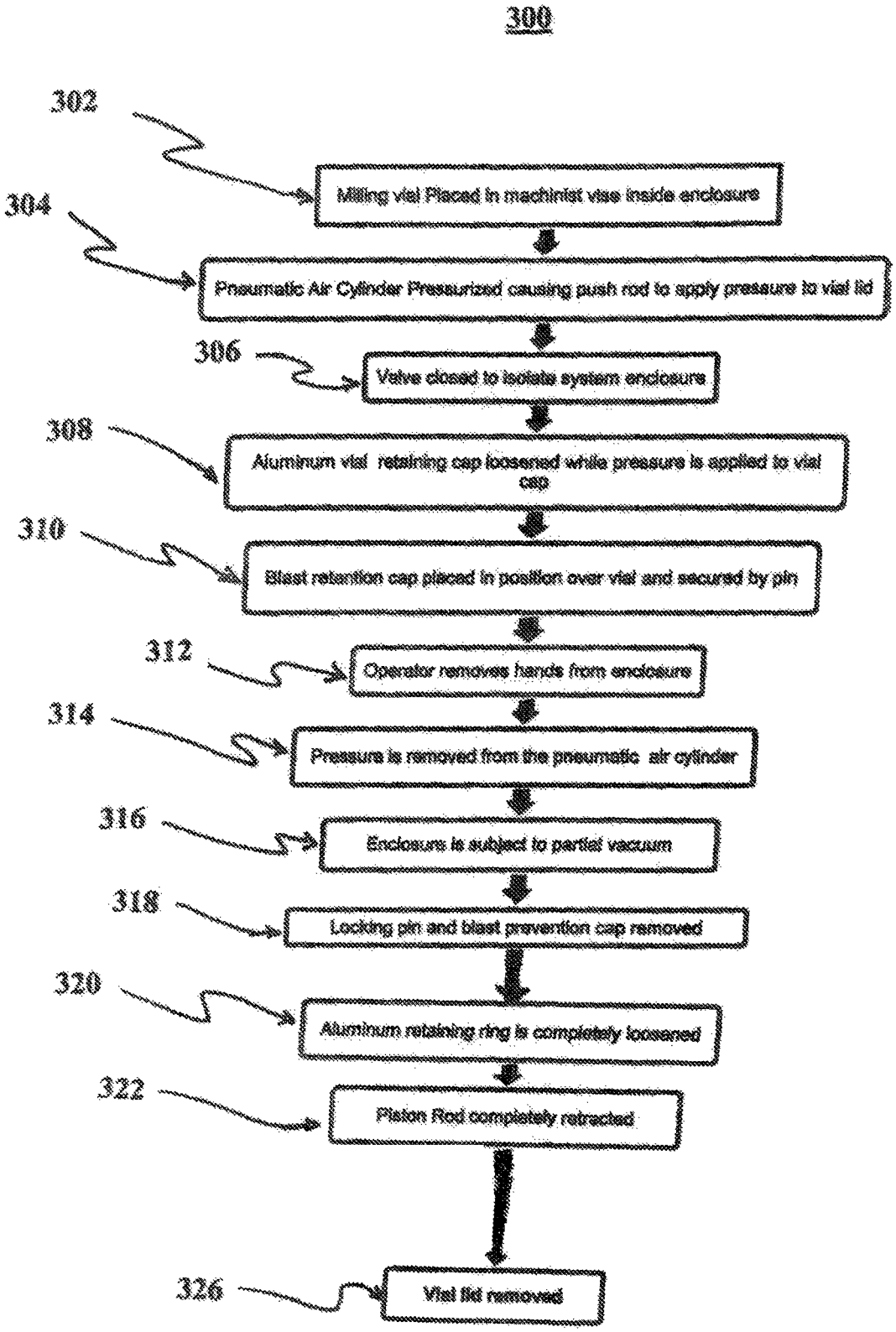
FIG. 3 depicts a flow diagram of the method in accordance with at least one embodiment of the present invention.

FIG. 3 depicts a flow diagram of the method in accordance with at least one embodiment of the present invention. In practice the vial, containing the milled powder among its contents, is loaded into the empty vise clamp by placing the vial between the vice jaws (302). The clamp is tightened, securing the vial in place directly under the push rod of the pneumatic air cylinder. Next, the pneumatic air cylinder is pressurized to a desired pressure between 25- and 200 psi (304). The pneumatic air cylinder is connected to a three way valve, one side of which is connected to an externally located pressurized high purity argon tank. One of the remaining two sides of the three way valve is connected to a vacuum line; while the third side of the three-way valve allows the system to be isolated.

Pressurizing the cylinder causes the push rod with an attached end cap to extend and make contact with the top of the vial securely holding the lid of the vial in place. Due to the force multiplying action of the pneumatic cylinder, the exerted pressure of the push rod is equal to or greater than that posed by the aluminum retaining cap or the internal pressure posed by any gases in the vial.

While the push rod is still applying pressure to the lid of the vial, the system is isolated (306). This is accomplished by turning the three way valve into the press control position. This action causes the pneumatic air cylinder to be isolated from the external argon tank. The aluminum retaining cap of the vial could now be loosened (308), anywhere from being completely loosened to just a few turns, by use of a pipe wrench. Without the piston rod in the downward position, the entire vial could depressurize in an unsafe manner. However, the risks to injury to the operator are now lower, as he is not handling the vial directly. Because the pressure in the pneumatic air cylinder exerts a downward force on the piston rod, holding the lid in place, direct contact or a pathway to the rest of the fuel in the vial is not available.

To release in a controlled manner the excess pressure in the vial, the blast prevention cap is then placed into position by sliding it down the push rod and completely covering the vial (310). Next, the blast prevention cap is locked in place by the locking pin, which is abutted between the top frame plate and top of the blast prevention cap. The operator then removes his hands from manipulating anything in the glove box (312). Standing on the side of the glove box, using the three-way valve, the side of which is connected to the vacuum system of the antechamber on the glove box, the operator can now remove the applied pressure in the pneumatic air cylinder system (314). The action of lowering the pressure in the air cylinder, below that of the ambient pressure in the glove box, causes the push rod to be retracted a short distance away from the top of the milling vial. This causes the internal vial pressure, if any, to lift the lid and drive the gaseous contents out and potentially explosively decompress. However, because the venting operation is done in an inert gas glove box, there is no oxidizer present (316). Therefore, the potential for rapid oxidation does not exist. Thus, any excess self-generated gas from decomposition of the vial contents and released from the vial into the glove box is rapidly removed from the glove box by the vacuum system.

The retraction distance, adjusted to be between (0.25 and 1.25 inches), is set by the total length of the extended piston rod above the top of the milling vial, and the length of the locking pin. Once the push rod is retracted, any gas present in the vial will produce an upward force on the blast prevention cap.

While highly unlikely, despite these steps, if a reaction or dramatic release of built up pressure was to still occur; the operator removed and is safe, being away from the vial. The contents of the vial are isolated: those being the lid, ball bearings, and milled powder. They are held in place by the locking pin underneath the blast prevention cap.

Thus, after a few seconds, once there is an indication on the pressure gauges of the glove box that the gases have been vented; the three-way valve is turned again into the down position to extend the piston rod onto the top of the vial. With the piston rod in position, the locking pin and blast prevention cap are removed (318). At this point, the aluminum retaining ring is completely loosened (320) and the piston rod can be completely retracted (322). The removal of the aluminum retaining ring completes the controlled depressurization of the vial and the lid can be also readily removed (326).

Depressurization the vial is shielded underneath the blast cap as well as under the added protection of the drill press vise and a one-inch thick aluminum plating as well as the glove box walls. The vials are opened remotely from a safe distance outside the glove box.

This device can be used in conjunction with other powder handling or processing operations, such as making powder compactions in an inert atmosphere. Glove box operations are used to minimize or prevent unwanted oxidation, nitridation, or any other contamination of the freshly milled powders with atmosphere. Placement of the device in the glove box reduces potential exposure to the ambient atmosphere to the particulate material and thus their contents are never exposed to the ambient atmosphere.

What is claimed is:

1. An apparatus for safely depressurizing milling vials comprising:

an enclosure;

a pneumatic air cylinder disposed within said enclosure;

a machinist vise in communication with said air cylinder and disposed within said enclosure;

a support structure to facilitate communication between said air cylinder and said machinist vise;

a plurality of suction cups disposed between said enclosure and said support structure.

2. The apparatus of claim 1 wherein said enclosure is a glove box type enclosure.

3. The apparatus of claim 1 wherein said air cylinder is positioned perpendicular to said milling vise.

4. The apparatus of claim 1 wherein said milling vise further comprises a static vise affixed to a vise base, a moving vise grip, movably attached to said vise base, a threaded screw plate affixed to said base, and a screw locking plate in communication with said screw plate and said movable vise grip.

5. The apparatus of claim 4 wherein said vise grips are configured to hold said milling vial.

6. The apparatus of claim 1 where the pneumatic air cylinder further comprises a pushrod in communication with said pneumatic air cylinder to said milling vise.

7. The apparatus of claim 1 further comprising a blast prevention cap disposed between said pneumatic air cylinder and said milling vial.

8. The apparatus of claim 1 wherein said enclosure contains means for viewing the inside of said enclosure from a blast resistant vantage point via a transparent polycarbonate structure.

9. The apparatus of claim 1 wherein said enclosure is formed of a blast resistant material.

10. A method for safely depressurizing milling vials comprising the steps of:

placing at least one milling vial having a lid on its top in a vise located within a blast resistant enclosure;

lowering a pneumatic air cylinder ram onto the milling vial lid;

evacuating the atmosphere of said enclosure;

loosening a vial retaining cap while applying constant pressure to the vial lid;

removing pressure from the pneumatic air cylinder ram;

retracting said pneumatic air cylinder ram from said vial lid;

opening said milling vial;

repressurizing said blast resistant enclosure to an ambient temperature; and removing said milling vial from said enclosure.

11. The method of claim 10 wherein said evacuation of atmosphere further comprises the replacing of said atmosphere with an inert atmosphere.

12. The method of claim 10 wherein the atmosphere has been partially evacuated.

13. The method of claim 10 wherein said pneumatic air cylinder ram is pressurized to a pressure within the range of 25-200 psi.

14. The method of claim 10 further comprising locking of the blast prevention retaining cap by inserting a locking pin.

15. The method of claim 10 further comprising retracting the pneumatic air cylinder ram a distance is within the range of 0.25 and 1.25 inches during the retracting and opening step.

16. The method of claim 10 wherein said pneumatic air cylinder ram is retracted a short distance by lowering the pressure in the pneumatic air cylinder ram.

17. The method of claim 10 wherein said vial retaining cap is formed from aluminum.

* * * * *